United States Patent [19]

Stark

[11] 4,393,530

[45] Jul. 19, 1983

[54] PILLOW

[76] Inventor: Lucille Stark, Pine Village II, Box 127, Hobart, Ind. 46342

[21] Appl. No.: 322,300

[22] Filed: Nov. 17, 1981

[51] Int. Cl.[3] ..... A47G 9/00

[52] U.S. Cl. ..... 5/437; 5/436

[58] Field of Search ..... 5/437, 442, 434, 435, 5/436, 438, 439, 440, 441, 462; D6/201

[56] References Cited

U.S. PATENT DOCUMENTS

| | | | |
|---|---|---|---|
| 247,892 | 10/1881 | Doremus | 5/442 |
| 1,296,930 | 3/1919 | Darling | 5/462 |
| 3,276,046 | 10/1966 | Capelli | 5/436 |
| 3,849,810 | 11/1974 | Degen | 5/442 |

FOREIGN PATENT DOCUMENTS

| | | | |
|---|---|---|---|
| 26072 | of 1908 | United Kingdom | 5/437 |

*Primary Examiner*—Alexander Grosz
*Attorney, Agent, or Firm*—Walter Leuca

[57] ABSTRACT

This invention is an improved pillow provided with a second pillow body as a component of the main pillow body. The second pillow body is connected to the main pillow body and pivotally moveable relative to the main pillow body to provide means for changing the contour or elevation of the head resting portion of the pillow while keeping the main pillow body in position to comfortably support the body.

1 Claim, 5 Drawing Figures

PILLOW

BACKGROUND OF THE INVENTION

1. Field of the Invention

This invention relates generally to pillows and more particularly to a pillow having a component part which is moveable to different positions and forms.

2. Description of the Prior Art

Pillows of the prior art that I am aware of are constructed as one unit in its entirety. Sleeping persons change their position frequently and for each position will require the head to be in a different position or at a different elevation to be comfortable. Consequently, when one changes position he manipulates his pillow to change its form or position in order to accommodate the changed position of his body and head. Since the prior art pillow is unitary in form, the person is required to elevate himself sufficiently to change the form of the pillow or its position to provide a comfortable pillow rest. In addition to this consideration, many persons, particularly women, utilize their pillow to support their head in such a way that it does not disturb their hair styling by providing support only at the nape of the neck. Since this concern is a prime consideration in such cases, the prior art pillow is manipulated to form a support solely for such an avoidance with no consideration to comfort since the prior art pillow is unitary in form and therefore can be manipulated only for one purpose at a time.

SUMMARY OF THE INVENTION

Accordingly, I have invented a pillow having a component part which is moveable from the rest of the pillow body so that it may be separately manipulated to provide means for changing the contour or elevation of the head resting portion of the pillow while keeping the rest of the pillow body in position to comfortably support the body.

I accomplish this by providing a second pillow body connected to a part of the main pillow body. The main pillow body is formed with end parts and a laterally extending side part. The end parts and the side part of the main pillow body are formed with suitable thickness to provide body resting support. The end parts and the side part deliniate a parameter around a central portion of the main pillow body which is formed at a depressed level. Fitted in the depressed mid portion of the main pillow body is a second pillow body to form an upper surface having a general continuity across the top thereof. The second pillow body may be pivoted upwardly and positioned at any elevation and otherwise manipulated to suit the comfort of the user or be elevated to fit in the neck portion of the user and thereby support individual parts of the body while the main body of the pillow serves to support the user shoulders and body portion. The second pillow body may also be pivoted completely upward to rest against the top part of the laterally extending side and thereby serve as a backrest to support the user in a sit-up position.

Other objects and advantages of this invention will become more apparent after a more careful study of the following detailed description taken together with the accompanying drawings wherein is illustrated a preferred embodiment of this invention.

DETAILED DESCRIPTION OF THE INVENTION

Figure 1:
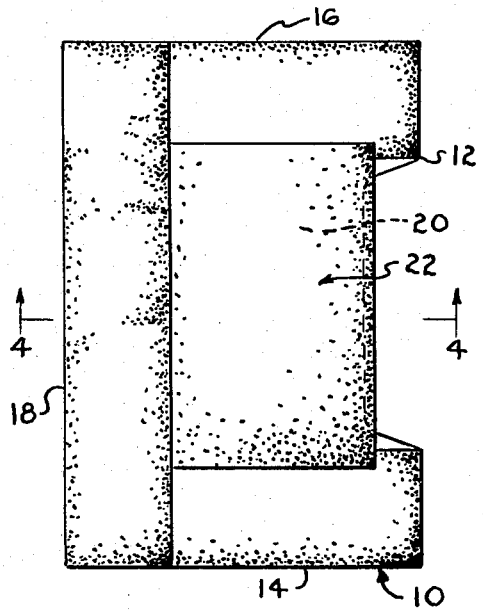
FIG. 1 is a plan view of the pillow of my invention.
Figure 2:
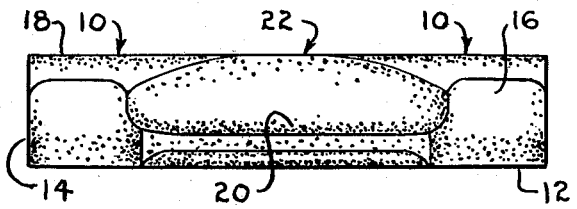
FIG. 2 is a front side view thereof.
Figure 3:
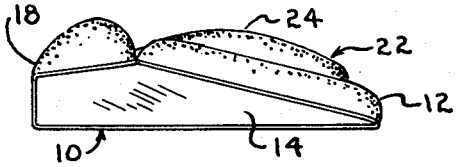
FIG. 3 is an end view thereof.
Figure 5:
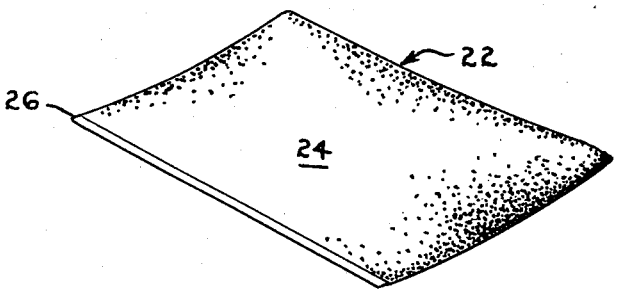
FIG. 5 is a perspective view of the second pillow body component of my invention.
Figure 4:
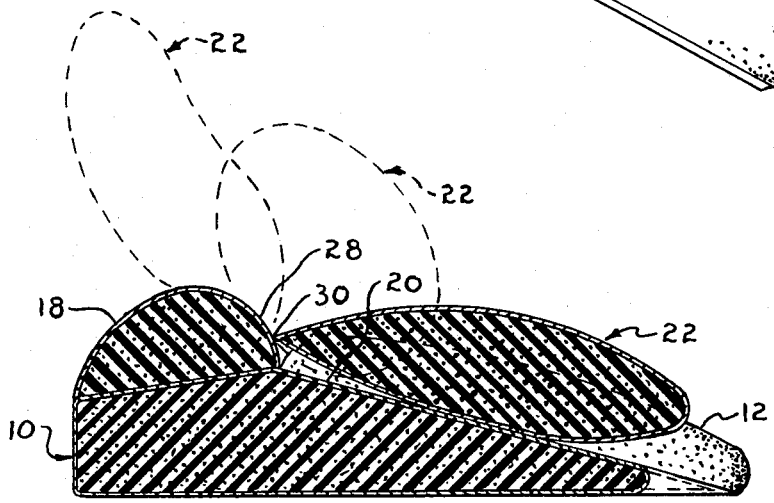
FIG. 4 is a cross-sectional view taken along lines 4—4 of FIG. 1, showing in dotted lines and changed positions and shapes of the second pillow body component thereof.

Referring now more particularly to the drawings wherein is illustrated a preferred embodiment of this invention, reference numeral 10 designates generally my novel pillow. It comprises a main pillow body 12 formed to include opposed end parts 14 and 16 having a thickness and contour to provide body supporting means and a laterally extending side part 18 therebetween likewise having a thickness and contour to provide body supporting means. The end and side parts 14, 16 and 18, respectively, are formed with body supporting material to provide an elevated form and provides a parameter for a central area 20 which is depressed in elevation. A second smaller, pillow body 22 is fitted within the confines of the depressed central area 20 and is similarly formed with body supporting material so that its upper surface 24 is approximately at the same elevation as the upper surfaces of end and side parts 14, 16, 18, of the main pillow body 12.

A strip or flap 26 extending from the upper or top side 24 of second pillow body 22 is secured as by sewing or otherwise connected to the infacing side 28 of the laterally extending side 18 of main pillow body 12 as at 30 by which means second pillow body 22 may be pivotly raised to different positions and shaped to fit against any part of the users head or neck. Second pillow body 22 may, in its raised position, be manipulated or arranged to form any desired shape dictated by the comfort of the user, without disturbing the position of the main pillow body.

In the operation of this invention, the main pillow body 12 is unitary in structure which, with the exception of center area 20, is formed with a body thickness approximately that of a conventional pillow. Center area 20 deliniated by opposing end parts 14 and 16, and side part 18 receives therein a second pillow body 22 connected to the main pillow body 12 by a sewing or equivalent connection between the flap 26 thereon and the infacing side 28 of lateral side part 18. Pillow 10 of this invention may be used as a convential pillow when the second pillow body 22 is positioned to rest entirely within depressed area 20, or as a multiple supporting pillow when the second pillow body 22 is moved away from the main pillow body 12 to accommodate one part of a persons body while the main pillow body 12 remains in its original position to accommodate another part of the persons body.

When the user desires to utilize pillow 10 of my invention to support his neck or head, or to use it as a back rest, he merely pivots second pillow body 22 to any position he desires and in any shape he forms to provide the maximum comfort without the necessity of raising himself to manipulate the main pillow body or to change the position thereof.

I claim:

1. A pillow comprising:

a pillow body having elevated opposed end parts, an elevated side part extending laterally between said end parts, said end parts and side part defining a generally "U" shaped frame and a depressed center part extending between said end parts and said side part;

a second pillow body fitted in said depressed center part of said pillow body providing a top surface substantially even in elevation with said side part and said end parts; and said second pillow body being connected to the side of said side part proximate to said depressed part for pivotal movement of said second pillow body out of said depressed center part against said elevated side part for support thereby in a position elevated above said end parts and side part.

* * * * *